US006105492A

United States Patent [19]

Fergen

[11] Patent Number: 6,105,492

[45] Date of Patent: Aug. 22, 2000

[54] DEVICE AND PROCESS FOR FORMING A MATRIX CAVITY

[75] Inventor: Alfons Fergen, Neuwied, Germany

[73] Assignee: Winkler + Dünnbier AG, Neuwied, Germany

[21] Appl. No.: 09/179,385

[22] Filed: Oct. 27, 1998

[30] Foreign Application Priority Data

Dec. 17, 1997 [DE] Germany ..... 197 56 094

[51] Int. Cl.[7] ..... B31F 1/07

[52] U.S. Cl. ..... 101/17; 101/16

[58] Field of Search ..... 101/17, 16, 13, 101/12, 6, 5, 4, 3.1, 25, 23, 22

[56] References Cited

U.S. PATENT DOCUMENTS

| | | | |
|---|---|---|---|
| 3,560,289 | 2/1971 | Otto et al. | 101/6 |
| 3,678,577 | 7/1972 | Weglin et al. | 29/624 |
| 4,159,677 | 7/1979 | Smith | 101/23 |
| 4,264,394 | 4/1981 | Izumihara | 101/25 |
| 4,288,275 | 9/1981 | Davis | 101/25 |
| 4,641,575 | 2/1987 | Cavagna | 101/23 |
| 4,732,082 | 3/1988 | Ireton | 101/23 |
| 4,776,912 | 10/1988 | Laval | 101/23 |
| 5,505,125 | 4/1996 | Kapolnek | 101/23 |
| 5,682,815 | 11/1997 | Kashio et al. | 101/22 |
| 5,752,442 | 5/1998 | Johnson et al. | 101/211 |
| 5,862,750 | 1/1999 | Dell'Olmo | 101/25 |
| 5,921,175 | 7/1999 | Bates | 101/23 |

FOREIGN PATENT DOCUMENTS

| | | |
|---|---|---|
| 854 404 | 11/1952 | Germany . |
| 362907 | 8/1962 | Germany . |
| 3007 615 | 4/1985 | Germany . |

*Primary Examiner*—John S. Hilten
*Assistant Examiner*—Anthony H. Nguyen
*Attorney, Agent, or Firm*—Collard & Roe, P.C.

[57] ABSTRACT

A process and device for forming a matrix cavity in the counter die of an embossing punch with an embossing device. The counter die is made of a tough, elastic to hard material such as a thermoplastic. The top die having a raised embossing pattern is pressed onto the counter die, which is heated, to form the matrix cavity.

6 Claims, 2 Drawing Sheets

38
3
21
36
22
43
35
42
37
6
46
5
31
37
45
39'
48
39
34
33
47
29
28
30
45
46
27
44
22
40
41
18
4
20
40'
7
8

DEVICE AND PROCESS FOR FORMING A MATRIX CAVITY

BACKGROUND OF THE INVENTION

1. Field of the Invention

The present invention relates to a device and process for forming a matrix cavity in an embossing device for paper processing machines.

2. The Prior Art

It is a common practice to emboss letter envelopes, paper napkins, paper handkerchiefs etc., with a design such as a company logo. Such embossings are produced in a paper processing machine in the course of the manufacturing process. Almost finished letter envelopes, letter envelope blanks, paper napkins, paper handkerchiefs etc. are embossed between two cooperating embossing dies, i.e., a top or counter die and a bottom die or matrix.

It is known to the manufacture both the top and counter die or the matrix from hardened steel, which offers the advantage of high resistance to wear. However, the manufacture of the top and bottom dies is very costly. Furthermore, the dies must be aligned with absolute precision because misalignment causes damage to the workpiece to be embossed and to the die itself.

Furthermore, it is known to manufacture the raised embossing die, i.e. the top die from hardened steel, and to employ a softened copper plate as the counter die. With this combination, the raised embossing or top die is pressed into the copper plate in the course of the run-in process, and a negative copy of the top die is produced in the plate, and forms a matrix cavity. It is advantageous in this process that the top die and the matrix so produced within the production machine are in precisely aligned positions relative to each other, and that their fitted form relative to each other is correct. However, this process has the drawback of a long run-in period in the production of the matrix cavity, and a large stress on the roll bearings.

Embossing dies have become known more recently where a top die produced from hardened steel is operating against a matrix made from a material with tough elasticity, e.g. plastic. This leads to excellent embossing results if the paper is not too thick. With this material combination, too, the cavity of the matrix is formed in a plate made from tough elastic material in the course of the run-in phase by the hard top die. This process is very time consuming and, on the average, lasts between 4 and 5 hours. Therefore, the running-in process is not carried out in a production machine itself.

SUMMARY OF THE INVENTION

It is therefore an object of the invention is develop a process and a device that enables the use of run-in embossing dies directly in a paper processing machine.

It is another object of the invention to provide a process and a device wherein the time for producing a matrix cavity by means of a hard embossing punch, i.e., the top die, is drastically reduced.

These and other objects of the invention are provided by a process for forming a matrix cavity within an embossing device for a paper processing machine having two rotatingly driven embossing rolls oppositely arranged in a conveying line for paper products. The process comprises adjusting the spacing between the embossing rolls so that a hard embossing punch comprising a top die having a raised embossing pattern and supported on one embossing roll is pressed against a counter die made of an elastic to hard material supported on the other embossing roll. The embossing punch and/or the counter die are heated, so that a permanent negative copy of the embossing pattern is embossed as a matrix cavity in the counter die by the embossing punch. This process is preferably performed directly on the paper processing machine.

The heating process can either be a hot air current or heat radiation. Preferably, the counter die is made of a thermoplastic and is heated until the surface of the counter die is in a plastic state.

The spacing between the embossing rolls is adjusted by reducing the spacing between the embossing rolls and simultaneously rotating the embossing rolls until the embossing punch penetrates the surface of the counter die with its embossing pattern and embosses a permanent negative copy of the embossing pattern in the counter die. Preferably, the embossing rolls continue to rotate until the counter die has cooled and the produced matrix cavity has solidified. The heating can be continued as the embossing rolls rotate.

The invention also provides for an embossing device for use in a paper processing machine comprising two rotatingly driven embossing rolls oppositely arranged on a conveying line for paper products. One embossing roll is supported in lateral machine frames and the other embossing roll is supported in adjustable lateral bearings. A hard embossing punch comprising a top die having a raised embossing pattern is supported on one embossing roll. A counter die made of elastic thermoplastic material having a tough and elastic surface is supported on the other embossing roll. The spacing between the embossing rolls is adjustable to create the matrix in the counter die as described above.

The thermoplastic used for the counter die is preferably an ultra high molecular weight low pressure polyethylene with a very high degree of polymerization.

The present invention has the advantage that the run-in process of the embossing device for producing a matrix cavity is carried out directly on a paper processing machine, and that the duration of the running-in time is reduced from 4 to 5 hours to 1 to 2 minutes. Furthermore, cost and wear are reduced by using a thermoplastic with tough elasticity for the counter die. This solution "forgives" minor adjustment flaws between the embossing punch and the counter die.

BRIEF DESCRIPTION OF THE DRAWINGS

Other objects and features of the present invention will become apparent from the following detailed description considered in connection with the accompanying drawing which discloses two embodiments of the present invention. It should be understood, however, that the drawing is designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
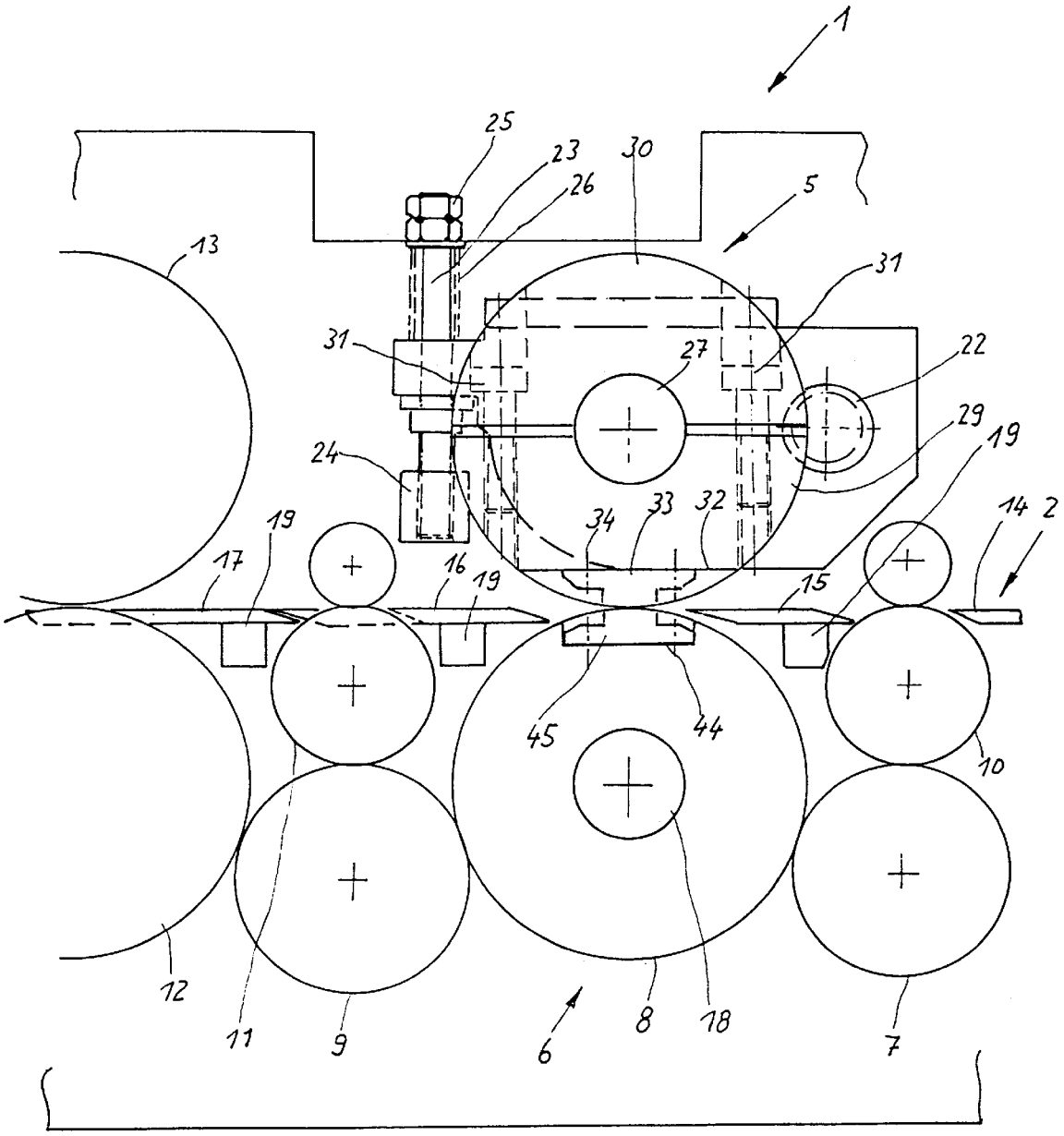
FIG. 1 shows a schematic side view of an embossing device.
Figure 2:
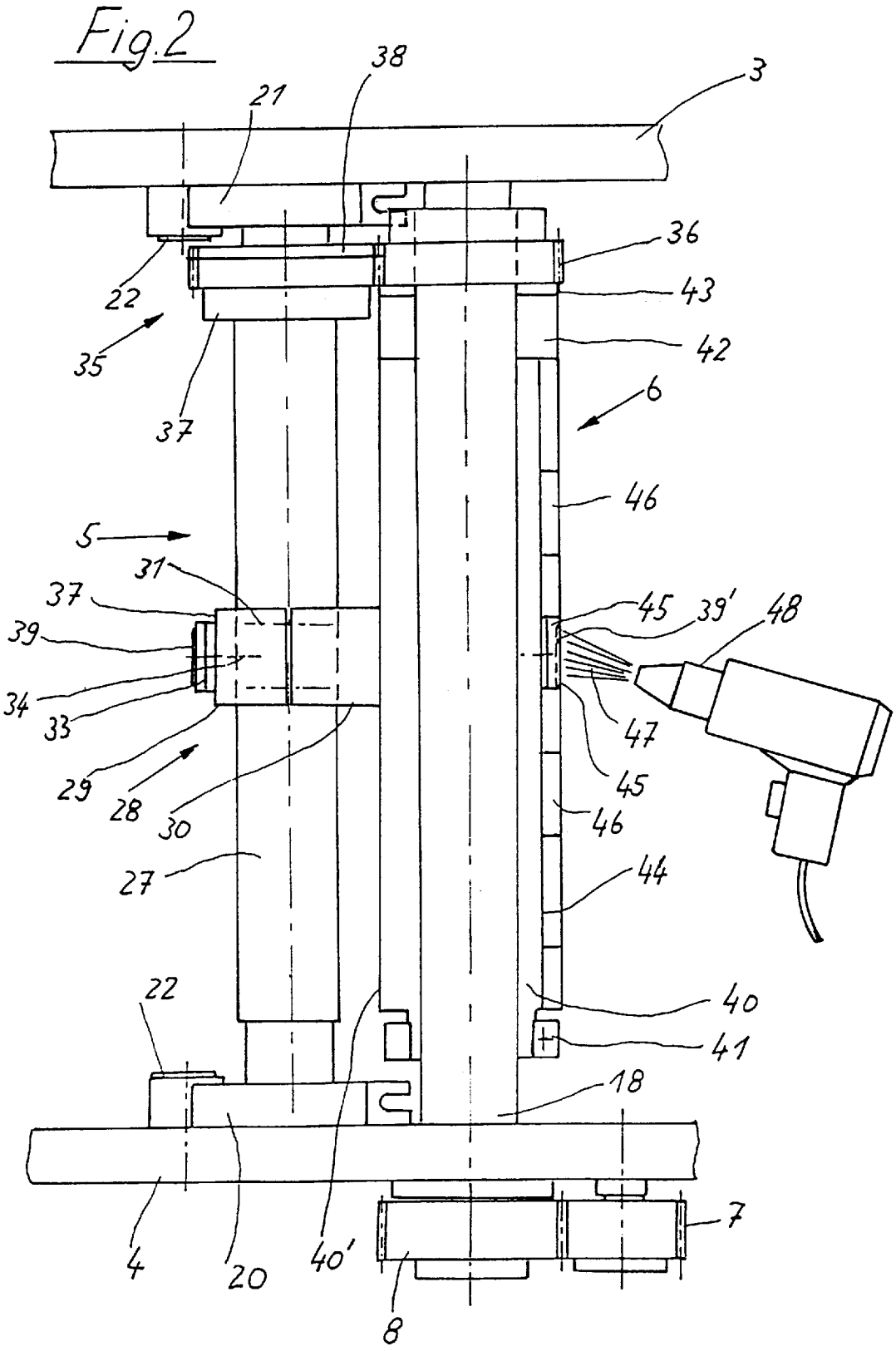
FIG. 2 shows a top view of the two embossing rolls.

Referring in detail to the drawings, FIGS. 1 and 2 show an embossing device 1 with a simple structure, which is arranged on a conveyor line 2 for letter envelopes. Embossing device 1 comprises machine frames 3 and 4, a top embossing roll 5 and a bottom embossing roll 6. There is a drive train comprised of a plurality of driving gears 7, 8, 9, by means of which feed and take-off rolls 10, 11, 12, 13, and also the bottom embossing roll 6 are driven. Guide plates 14, 15, 16, 17 are arranged between rolls 10, 6, 11, 12, and are tangent to conveyor line 2 from the bottom and mounted on cross bars 19.

Bottom embossing roll 6 is rotatably supported in machine frames 3, 4 by a driving shaft 18. Bottom embossing roll 6 is rotationally driven via its associated driving gear 8, which is supported with torsional strength on driving shaft 18 outside of machine frame 4. Top embossing roll 5 can be fixed in its position relative to bottom embossing roll 6 and is rotatably received on its ends in swing bearings 20, 21. Swing bearings 20, 21 are in turn pivotally supported at one end on machine frame 3, 4 by a bolt 24, which is in a fixed position. Via pressure on rings 26, which are arranged on screw bolts 24 and supported there on nuts 25, and which apply pressure to swing bearings 20, 21 from the top, an adjustable force is applied to swing bearings 20 and 21 and thus on top embossing roll 5. This force is directed toward bottom embossing roll 6. Furthermore, top embossing roll 5 is adjustable relative to bottom embossing roll 6 by turning screw bolts 23 into their supporting bolts 24.

Top embossing roll 5 has a shaft 27, on which a punch support 28 is tightly clamped in such a manner that it can be displaced and turned. Punch support 28 consists of a supporting part 29 and a clamping part 30. Parts 29 and 30 are clamped on shaft 27 by screw 31. A supporting surface 32 is beveled to supporting part 29, and a top die or punch 33 with a raised embossing pattern 39 is fixed aligned on surface 32 by screws 34. In addition to swing bearing 21, a double toothed gear 35 is fixed on shaft 27, and engages a toothed driving gear 36, which is supported and secured on driving shaft 18 of bottom embossing roll 6. Double toothed gear 35 consists of a toothed gear 37 clamped on shaft 27, and an idler gear 38 arranged coaxially with and next to gear 37. To reduce the tooth play toward toothed gear 36, idler gear 38 is tensioned versus toothed gear 37 in the direction of rotation by means of spring elements (not shown). This technique is generally known and not shown and described here in greater detail.

Bottom embossing roll 6 comprises a driving shaft 18, which is mounted by pushing it over a roll body 40, where it is locked with torsional strength with the help of a clamping device 41. Spacer rings 42, 43 are arranged between roll body 40 and toothed gear 36. The outside diameter of spacer rings 42, 43 is adapted to roll body 40. A groove 44 is cut into roll body 40 from the outside, extending axially parallel over the entire length. Opposite embossing punch 33, a plate-like counter die 45, made from tough elastic material such as a thermoplastic, is secured in an aligned manner in groove 44. To the left and right of counter die 45, groove 44 is covered with filler pieces 46 having outer diameters that bridge over groove 44.

The process for producing the matrix cavity is described in the following steps:

(A) Top embossing roll 5 is removed from bottom embossing roll 6 within the range of engagement of toothed gears 35 and 36 by unscrewing screw bolts 23 from supporting bolt 24.

(B) Embossing punch (top die) 33 with raised embossing pattern 39 is aligned and tightened on supporting surface 32 of punch support 28 by screws 34.

(C) Plate-like counter die 45 is installed within groove 44 of bottom embossing roll 6 so that it is aligned with embossing punch 33. Counter die 45 is preferably made from an ultra high molecular weight low pressure polyethylene and has a smooth, outwardly bent surface 45', which corresponds with the outside diameter of jacket 40' of roll body 40.

(D) Surface 45' of counter die 45 is heated in a hot air current 47 of a hot air blower 48 until surface 45' is in a plastic, doughy state. Alternatively, radiant heat (not shown) can be used.

(E) Top embossing roll 5 is positioned against bottom embossing roll 6 while continuing the feed of heat to counter die 45 and simultaneously rotating embossing rolls 5 and 6 until raised embossing pattern 39 has dug itself into the heated, plasticized surface 45' of counter die 45 and has produced a negative copy of embossing pattern 39 as matrix cavity 39'.

(F) The rolls are continued to be rotated until surface 45' of counter die 45 has cooled and a matrix cavity 39' has been permanently formed.

(G) Embossing roll 5 is then set apart from embossing roll 6 until the spacing amounting to the thickness of paper has been reached between the lowered setting of the embossing punch and the raised setting of the counter die.

Counter dies 45 that have been worn by abrasion can be fully regenerated by reheating counter die 45 and tightening the setting of embossing die 33 against counter die 45 as embossing rolls 5 and 6 are rotating.

Accordingly, while only a single embodiment of the present invention has been shown and described, it is to be understood that many changes and modifications may be made thereunto without departing from the spirit and scope of the invention as defined in the appended claims.

What is claimed is:

1. A process for forming a matrix cavity within an embossing device for a paper processing machine, the machine having two rotatingly driven embossing rolls oppositely arranged in a conveying line for paper products, comprising the steps of:

reducing the spacing between the embossing rolls by simultaneously rotating the embossing rolls so that a hard embossing punch comprising a top die having a raised embossing pattern supported on one embossing roll penetrates the surface of a counter die;

said counter die made of elastic thermoplastic material of high molecular weight polyethylene with a very high degree of polymerization and having an elastic surface supported on the other embossing roll; and heating at least one of the embossing punch and counter die until the surface of the counter die is in a plastic state and continuing the heating as the embossing rolls rotate, wherein a permanent negative copy of the embossing pattern is embossed as a matrix cavity in the counter die by the embossing punch.

2. The process according to claim 1, wherein the matrix cavity is produced in the counter die directly on the paper processing machine.

3. The process according to claim 1, wherein the counter die is heated in a hot air current.

4. The process according to claim 1, wherein the counter die is heated by heat radiation.

5. The process according to claim 1, wherein the embossing rolls continue to rotate until the counter die has cooled and the produced matrix cavity has solidified.

6. An embossing device for use in a paper processing machine, comprising:

two rotatingly driven embossing rollers oppositely arranged on a conveying line for paper products, one embossing roll being supported in lateral machine frames and the other embossing roll being supported in adjustable lateral bearings;

a hard embossing punch comprising a top die having a raised embossing pattern supported on one embossing roll;

a counter die made of elastic thermoplastic material of high molecular weight polyethylene with a very high degree of polymerization and having an elastic surface supported on the other embossing roll, a heat source for heating at least one of the embossing punch and counter die;

wherein the spacing between the embossing rolls is adjustable so that the hard embossing punch creates a negative matrix on the counter die when the embossing punch is pressed against the counter die.

* * * * *

UNITED STATES PATENT AND TRADEMARK OFFICE

CERTIFICATE OF CORRECTION

PATENT NO. : 6,105,492
DATED : August 22, 2000
INVENTOR(S) : Alfons FERGEN

It is certified that error appears in the above-identified patent and that said Letters Patent is hereby corrected as shown below:

On the title page, column 1, Item [73], change the spelling of the assignee to read --Winkler + Dünnebier AG--.

Signed and Sealed this

Eighth Day of May, 2001

*Attest:*

Nicholas P. Godici

NICHOLAS P. GODICI

*Attesting Officer*

*Acting Director of the United States Patent and Trademark Office*